United States Patent [19]

Morimoto et al.

[11] Patent Number: 4,529,259

[45] Date of Patent: Jul. 16, 1985

[54] TWO BULB LAMP SOCKET

[75] Inventors: Ikuhisa Morimoto; Yasuhiko Kimura; Masaaki Nakamura, all of Mie, Japan

[73] Assignee: Matsushita Electric Works, Ltd., Osaka, Japan

[21] Appl. No.: 486,077

[22] Filed: Apr. 18, 1983

[51] Int. Cl.[3] ..... H01R 13/50

[52] U.S. Cl. ..... 339/155 L

[58] Field of Search ..... 339/154, 155, 156 R, 339/157 R, 158

[56] References Cited

U.S. PATENT DOCUMENTS

| | | | |
|---|---|---|---|
| 760,376 | 5/1904 | Benjamin | 339/160 |
| 938,632 | 11/1909 | Benjamin | 339/160 |
| 1,007,419 | 10/1911 | Benjamin | 339/160 |
| 1,097,208 | 5/1914 | Barr | 339/160 |
| 1,160,435 | 11/1915 | Morey | 339/199 R |
| 1,220,608 | 3/1917 | Cuthbert | 339/160 |
| 1,672,556 | 5/1928 | Both | 339/161 |
| 1,848,812 | 3/1932 | Wiley | 339/199 R |
| 2,231,585 | 2/1941 | Maslin | 339/180 |
| 2,618,678 | 3/1950 | Gast | 339/180 |
| 3,686,621 | 8/1972 | Ruston | 339/180 |
| 4,257,664 | 3/1981 | Munroe | 339/176 L |

*Primary Examiner*—Gil Weidenfeld
*Assistant Examiner*—David L. Pirlot
*Attorney, Agent, or Firm*—Stevens, Davis, Miller & Mosher

[57] ABSTRACT

A two bulb lamp socket is provided with a housing which defines a first recess and first and second insertion openings below the recess. A switch for switching bulbs on and off is located in the recess. Each insertion opening is provided with a contact in the upper central portion of the opening, and with a side contact on the sides of the openings. Each opening is provided with an insulated engaging means for mechanically engaging a bulb which is screwed into the opening.

2 Claims, 4 Drawing Figures

TWO BULB LAMP SOCKET

BACKGROUND OF THE INVENTION

1. Field of the Invention

The present invention is directed to a lamp socket for two bulbs, such as a regular bulb and a miniature bulb. One switch is used to control the lighting of both bulbs.

2. Description of the Prior Art

In the past, this type of lamp socket has included metal sockets provided with screw threads. The bulbs are screwed into these sockets, which mechanically hold both bulbs and provide electrical contact, since the sockets are made of metal. Such sockets have had disadvantages since a consumer inserting a bulb into the socket could suffer an electrical shock upon accidental contact with the base of the bulb. Furthermore, connection between the base of each bulb and a terminal strip and connection between the terminal strips have been difficult to carry out because of the use of a pipe eyelet (hollow rivet) for both electrical connection and mechanical engaging of the bulb.

SUMMARY OF THE INVENTION

It is an object of this invention to provide a lamp socket for two bulbs which uses one part for mechanically engaging and another for electrically contacting a bulb held in the socket.

It is a further object of this invention to provide a lamp socket which reduces the likelihood of electric shock to a consumer inserting a bulb into the socket.

It is a still further object of this invention to provide a lamp socket which is easy to assemble and which does not use the pipe eyelet.

It is a still further object of this invention to provide a lamp socket which does not have excessive heating at the electrical connection points.

The above objects and others are obtained by providing a lamp socket including a housing which defines a first recess, a first lamp insertion opening between the recess and a second lamp insertion opening below the recess and adjacent the first opening. Contacts are located in the upper center portions of each of the insertion openings. Contacts are also located at the sides of the insertion openings. Each insertion opening is provided with an engaging member for supporting a bulb in the insertion opening. Each engaging member is insulated from the power source.

BRIEF DESCRIPTION OF THE DRAWINGS

The present invention can be further understood by reading the following description in conjunction with the drawings, in which.

DETAILED DESCRIPTION OF THE INVENTION

Figure 1:
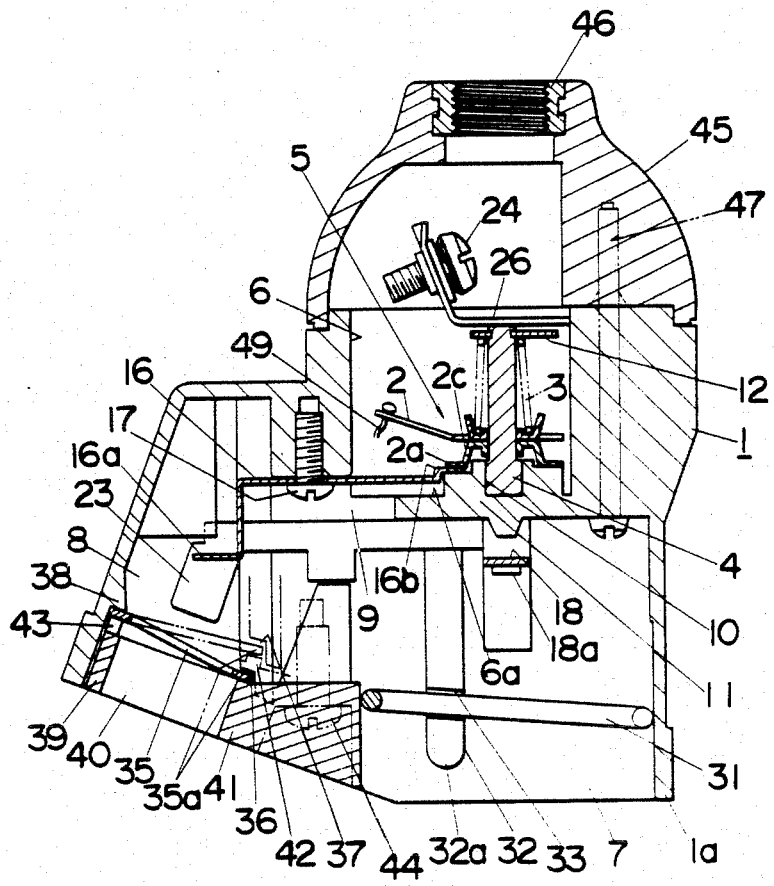
FIG. 1 is a longitudinal sectional view of one embodiment of the present invention.

Referring to the drawings, socket housing 1 defines a recess 6. Rotary plate 2, which is rotatable for turning bulbs (not shown) on and off, and switch 5 are located within the recess 6. The switch includes a coil spring 3 which downwardly biases the rotary plate 2 and provides a restoring force to the plate 2 and a center shaft 4. The rotary plate 2 bears against a conductive body 2*c*, which is rotatable with the rotary plate 2. The conductive body 2*c* is provided with legs 2*a* and 2*b*, which are symmetric with respect to the axis of center shaft 4. Switches of this type are standard and well-known in the art.

Insertion openings 7 and 8 are provided in the lower portion 1*a* of the housing. The housing is made of an insulating material, such as plastic. It is usual but not mandatory that the opening 8 accept a miniature bulb, while opening 7 accepts a standard bulb. These openings communicate with each other. Both openings are located beneath the recess 6. Recess 6 communicates with insertion opening 8 through bore 9. At the bottom 6*a* of the recess, there is formed a bearing bore 10 for the center shaft 4. A step portion 11 is provided around the bearing bore. The step portion 11 is divided into six parts.

Figure 3:
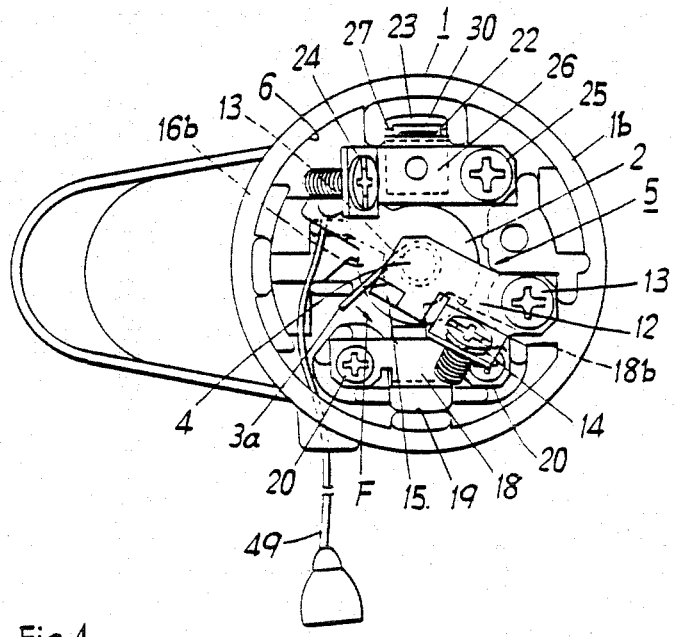
FIG. 3 is a plan view of the embodiment of FIG. 1 with the cover removed.

Support terminal strip 12 is fixed to the upper part of the housing 1 through a screw 13 (FIG. 3) and a terminal screw 14 is provided, thus pivotally supporting the center shaft 4 in the bearing bore 10. Stopper 15 is formed by downwardly bending a portion of the support terminal strip 12, with spring 3 having its end 3*a* bent downwardly to contact the stopper 15 and bias it.

The insertion opening 8 is provided with a center contact 16, whose end 16*a* is provided at substantially the upper center section of the insertion space 8. End 16*b* of the contact extends through bore 9, is placed on one part of the step portion 11 and is fixed to housing 1 through use of screw 17. Insertion opening 7 is provided with a center contact 18 provided at substantially the upper center portion of the insertion space 7. The other end 18*b* is placed on the step portion 11, not adjacent to end 16*b*, and is fixed to housing 1 by means of screw 20.

Figure 4:
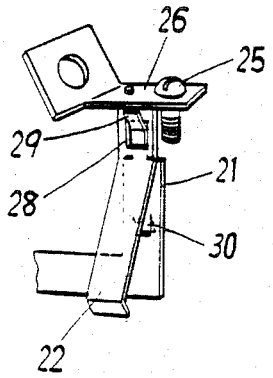
FIG. 4 is a perspective view of a side contact used in the embodiment of FIG. 1.

Side contact member 21 includes a side contact 22 which enters into insertion space 7 and a side contact 23 which enters into insertion space 8. The insertion spaces form "sockets" for accepting bulbs. As seen in FIG. 4, side contact 22 can be fixed to a terminal strip 26 which is provided with terminal screw 24 (FIG. 3) and fixed to housing 1 through screw 25. Side contact 22 thus extends into the insertion space 7. As can be seen in FIG. 4, side contact 22 may be provided with a rectangular opening 28.

Side contact 23 extends from opening 8, through opening 7, and is provided with a bent portion 29 which extends through the bore 27 between recess 6 and the lamp insertion opening 7. Tongue 29 cooperates with rectangular opening 28 of side contact 22. A pawl 30 is provided to contact the edge of bore 27 to ensure contact with side contact 22. Thus, side contact 23 is electrically connected with side contact 22 without passing through a hollow rivet. Side contacts 22 and 23 are each fixed to the housing 1.

Figure 2:
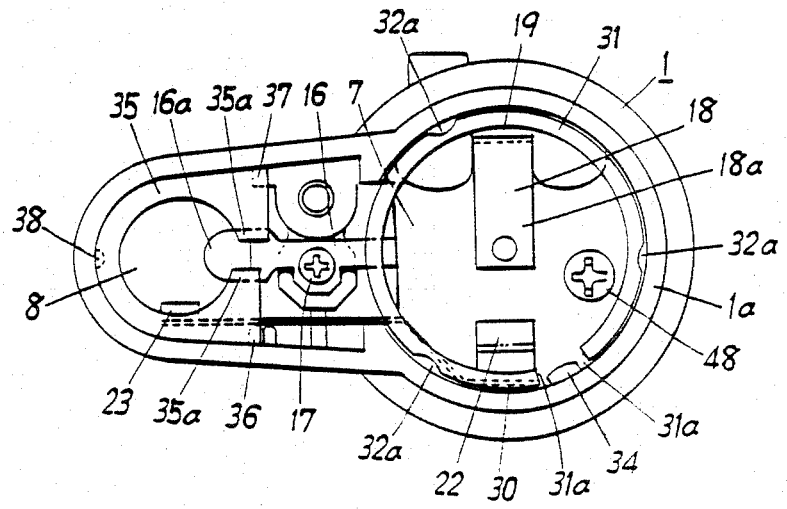
FIG. 2 is a bottom view of the embodiment of FIG. 1.

Insertion opening 7 is provided with a metal fitting 31, which may be a substantially C-shaped slit ring made of piano wire for example. The ends of the ring may be offset a distance approximately equal to the pitch of the thread of a bulb base. This facilitates screwing of a bulb into the socket. The "pitch" of the thread refers to the distance between adjacent crests of the thread. The fitting 31 is mounted in recesses 33 provided in projections 32. These projections 32 are preferably provided at 120° intervals around the insertion opening 7. The recesses 33 can be formed during molding of the projections 32, or they can be cut after molding. As can be seen in FIG. 2, positioning projection 34 corresponds to the slit ends 31*a* of the metal fitting 31. Furthermore, the height of projections 32*a* may be changed to further secure the electric bulb and prevent tilting of the bulb. Also, fitting 31 may be formed by a contraction process so as to be insertably mounted in opening 7.

Insertion opening 8 is provided with a plate member 35. Like the fitting 31, plate 35 may be formed to be substantially C-shaped, with the ends of the plate being offset by a distance equal to the pitch of the thread of a bulb to facilitate screwing of the bulb into the insertion opening 8. Retaining portions 36, 37 and 38 can be formed in the housing 1. Lid body 39 provides an insertion bore 40 for a bulb, and forms biasing portions 41, 42 and 43 which correspond to the retaining portions 36–38. The lid body 39 is fitted into the insertion opening 8 and can be fixed by use of screw 44.

Fitting 31 and plate 35 are not involved with supplying current to the bulbs. Thus, the fitting and plate are insulated from current during insertion of a bulb. Of course some current may be carried by the fitting and plate after a bulb touches contact 16 or 18, but the bulb is far enough inside the socket at this point to reduce the danger of a consumer accidentally touching the fitting or plate and experiencing a shock. The bulb will not carry current until it reaches the contacts, which are relatively deep within the housing. Thus, danger of shock from accidentally touching the bulb base is reduced. The fitting and plate can be considered as substantially insulated from the power source.

The socket can be provided with a cover 45, which when used for a desk lamp, includes insert molded threaded fitting 46 which can cooperate with a conduit (not shown). The cover is fitted onto bore 1*b* of the housing 1 and is secured via an insertion bore 47 which accepts assembling screw 48.

An electric bulb is screwed into insertion opening 31 and is mechanically held by metal fitting 31. The bulb electrically contacts with center contact 18 and side contact 22. A second bulb, usually a miniature bulb, is screwed into insertion opening 8 and is mechanically held by plate 35. This bulb electrically contacts center contact 16 and side contact 23. A cord 49 is pulled to rotate the rotary plate 2, thus switching the bulbs on or off. Also, as can be seen in FIG. 1, the rotary plate may be designed so that the plate 2 may contact only end 16*b* at one position, which allows the miniature lamp to remain on. It is preferred that the switch energize the main bulb, alone energize the minature bulb alone, and de-energize both bulbs.

As can be seen from the above, the two bulb lamp socket of this invention includes a housing 1 which is provided with a recess 6 in which inverting mechanism 5 is located, and which is provided at its lower surface 1*a* with electric lamp insertion openings 7 and 8. The openings 7 and 8 communicate with each other. Center contacts 16 and 18 are provided at substantially the upper central portion of each of the openings 7 and 8. Each opening is also provided with side contacts 22 and 23. Metal fitting 31 and plate 35 are provided to mechanically hold bulbs within the insertion openings. Lid body 39 provided with insertion bore 40 may be fitted into the opening of insertion space 8 for mounting the plate member 35. Fitting 31 and plate member 35 do not have any electric current. Thus, electric shock can be avoided, even when a consumer accidentally touches the fitting 31 or plate member 35. Since the insertion opening 7 and insertion opening 8 are in communication with each other, side contact 23 can be inserted from the lower surface 1*a* of the housing 1, thus allowing easy assembly without the use of a hollow rivet and preventing excessive heating at electrical conection points.

What is claimed is:

1. A lamp socket, comprising:

a housing defining a first recess, a first insertion opening below said first recess and communicating with said first recess through a first aperture, and a second insertion opening below said first recess, adjacent and communicating with said first insertion opening, and communicating with said first recess through a second aperture;

a switch in said first recess;

a first contact in an upper center portion of said first insertion opening, electrically connected with said switch;

a second contact in an upper center portion of said second insertion opening, electrically connected with said switch, extending from said first recess, through said second aperture and into said second insertion opening;

a first side contact at one side of said first insertion opening, extending from said first recess, through said first aperture and, said first side contact having a hole therethrough;

a second side contact at one side of said second insertion opening, connectable with a power source, extending from said first recess, through said first aperture, into said first insertion opening and into said second insertion opening, contacting said first side contact in said first recess by means of a tongue inserted in said hole and resting on the edge of said first aperture;

first engaging means within said first insertion opening for supporting the base of a bulb inserted in said first insertion opening, substantially insulated from said first contact and said first side contact, said first side contact being between said first contact and said first engaging means, said first engaging means comprising a metal fitting of substantially C-shaped configuration, the ends of said C-shaped fitting being spaced apart a distance equal to the pitch of the thread of a bulb inserted in said first insertion opening; and second engaging means within said second insertion opening for supporting the base of a bulb inserted in said second insertion opening, substantially insulated from said second contact and said second side contact, said second side contact being between said second contact and said second engaging means, said second engaging means comprising a plate of substantially C-shaped configuration, the ends of said C-shaped plate being spaced apart a distance equal to the pitch of the thread of a bulb inserted in said second insertion opening; and a lid body fixed to said housing in said second insertion opening, comprising an insertion bore, supporting said second engaging means.

2. A socket as claimed in claim 1 further comprising a plurality of notched, inwardly-extending projections on the periphery of said first insertion opening, said first engaging means being held by the notches of said projections.

* * * * *